United States Patent [19]

Kolthoff

[11] 4,319,866

[45] Mar. 16, 1982

[54] FAN

[75] Inventor: C. Paul Kolthoff, Naperville, Ill.

[73] Assignee: International Harvester Company, Chicago, Ill.

[21] Appl. No.: 114,436

[22] Filed: Jan. 22, 1980

[51] Int. Cl.[3] ..... F04D 29/34

[52] U.S. Cl. ..... 416/210 R; 416/132 A; 416/212 R; 416/243

[58] Field of Search ..... 416/210 R, 132 A, 243 A, 416/212 R

[56] References Cited

U.S. PATENT DOCUMENTS

| | | | |
|---|---|---|---|
| 695,917 | 3/1902 | Dominick | 416/210 R |
| 1,007,183 | 10/1911 | Clark | 416/210 R |
| 2,072,196 | 3/1937 | Berger | 416/132 A |
| 2,388,464 | 11/1945 | Bergen | 416/210 R |

FOREIGN PATENT DOCUMENTS

| | | | |
|---|---|---|---|
| 461580 | 2/1937 | United Kingdom | 416/212 R |

*Primary Examiner*—Douglas Hart
*Attorney, Agent, or Firm*—F. David AuBuchon

[57] ABSTRACT

A fan blade assembly having a spider shaped or formed from rod, wire or bar stock.

12 Claims, 16 Drawing Figures

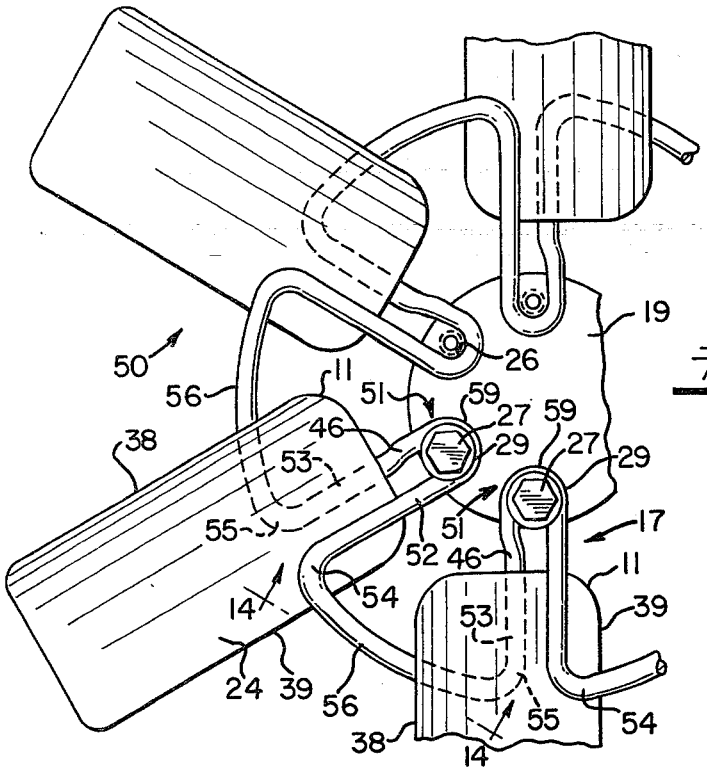
FIG. 13
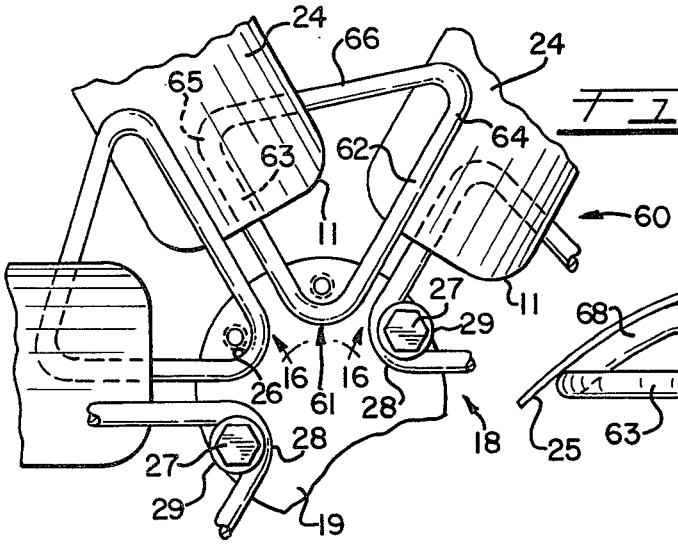
FIG. 15
FIG. 16
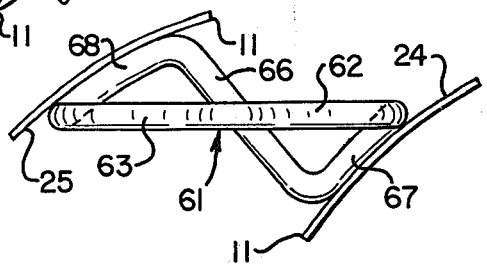
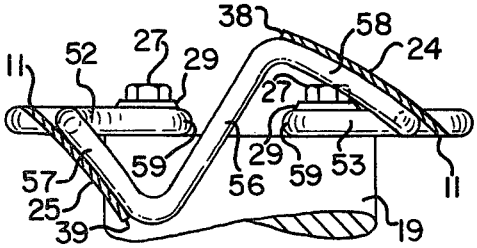
FIG. 14

FAN

This invention relates to a fan, in particular to a fan blade assembly and a spider formed or shaped from rod, wire or bar stock.

Heretofore, fan blade assemblies comprised a plurality of fan blades riveted to either one spider, or sandwiched between two spiders separated by a spacer. The manufacture of the fan blade assemblies was costly, as it required considerable hand labor, and the finished product was heavy, as the blades and spiders were substantially made from sheet metal stampings.

My invention provides for a less costly and lighter fan blade assembly, which is adaptable to automated assembly. The fan blades may be made from plastic or metallic materials, and the spider formed by bending and shaping wire or bar stock. My fan blade assembly comprises a plurality of fan blades circumferentially spaced about a central rotational axis, and a plurality of slender rod members equal in number to the plurality of fan blades, which are bent intermediate the ends thereof forming first and second arms bridged by an arch. The bent rods are circumferentially spaced about the central rotational axis with the arches diverging towards the central rotational axis. The first arms extend radially outwardly and respectively embrace one side of the circumferentially spaced fan blades and the second arms extend radially outwardly substantially parallel to the first arms and respectively embrace the second side opposite the one side of the circumferentially spaced fan blades. The fan blades are angularly and radially adjustable between their respective embracing first and second arms and are fixed thereto at a selected pitch and outside diameter. The one side of each fan blade is shaped convex and the second side is shaped concave. The bent member may be bent at an obtuse angle or at an acute angle, at the arch, forming either a generally V-shape or a U-shape member, and the first and second arms may be of equal or unequal length. A hub member may be provided fixing the arches of the bent members thereto. Fastening means may be provided in the space between the first and second arms and the arch for fastening the fan blade assembly to a rotor. The terminal ends of the arms may be connected to adjacent arms of adjacent bent members forming a rosette; or the terminal ends of the arms of each bent member may be connected to one another forming a plurality of generally triangular shaped pieces. The terminal end portions of the arms may also be bent curving around the front and rear surfaces of the fan blades and the ends bent into hooks hooked to the edges of the fan blades securing the fan blades thereto; or holes may be provided in the convex and concave surfaces of the fan blades with the hooked ends of the terminal end portions hooked therein.

In order that my invention may be readily understood and put into practical effect, reference will now be made to the various figures of the drawing in which:

FIG. 13 is a partial front view of a sixth embodiment of the fan blade spider;

FIG. 14 is a partial end view taken on lines 14—14 of FIG. 13;

FIG. 15 is a partial front view of a seventh embodiment of the fan blade spider; and FIG. 16 is a partial end view taken on lines 16—16 of FIG. 15.

Figure 6:
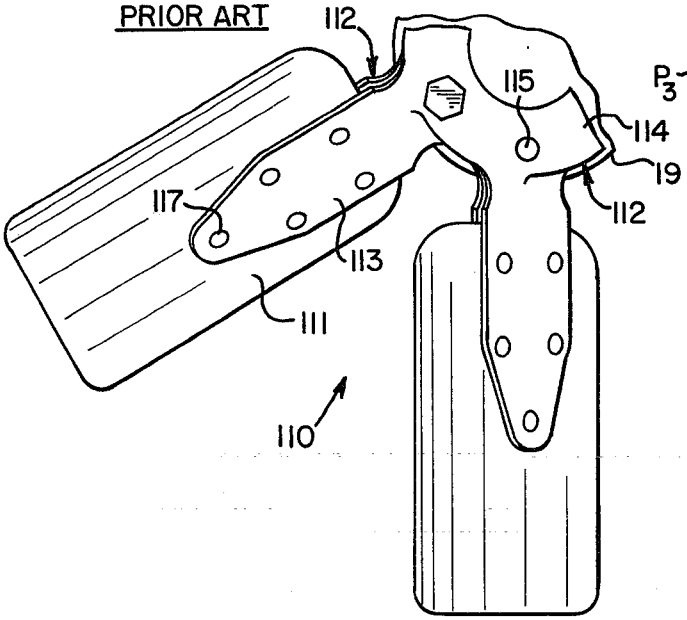
FIG. 6 PRIOR ART
FIG. 6 shows a prior art fan blade assembly.

A prior art fan blade assembly 110 is fragmentarily shown in FIG. 6, which comprises a plurality of identical fan blades 111, respectively connected to a similar number of uniformly circumferentially spaced arms 113 radially projecting from a central ring hub portion 114 of a fan spider 112. The fan blades 111 are fixed to the radial arms 113 by any suitable fastening means, such as by a plurality of rivets 117, or by a number of spot welds, and the completed fan blade assembly 110 is mounted for rotation to a rotor or motor shaft 19, for example, by a plurality of uniformly circumferentially spaced bolts 118 passing through holes 115 provided for this purpose around the ring hub portion 114.

Figure 1:
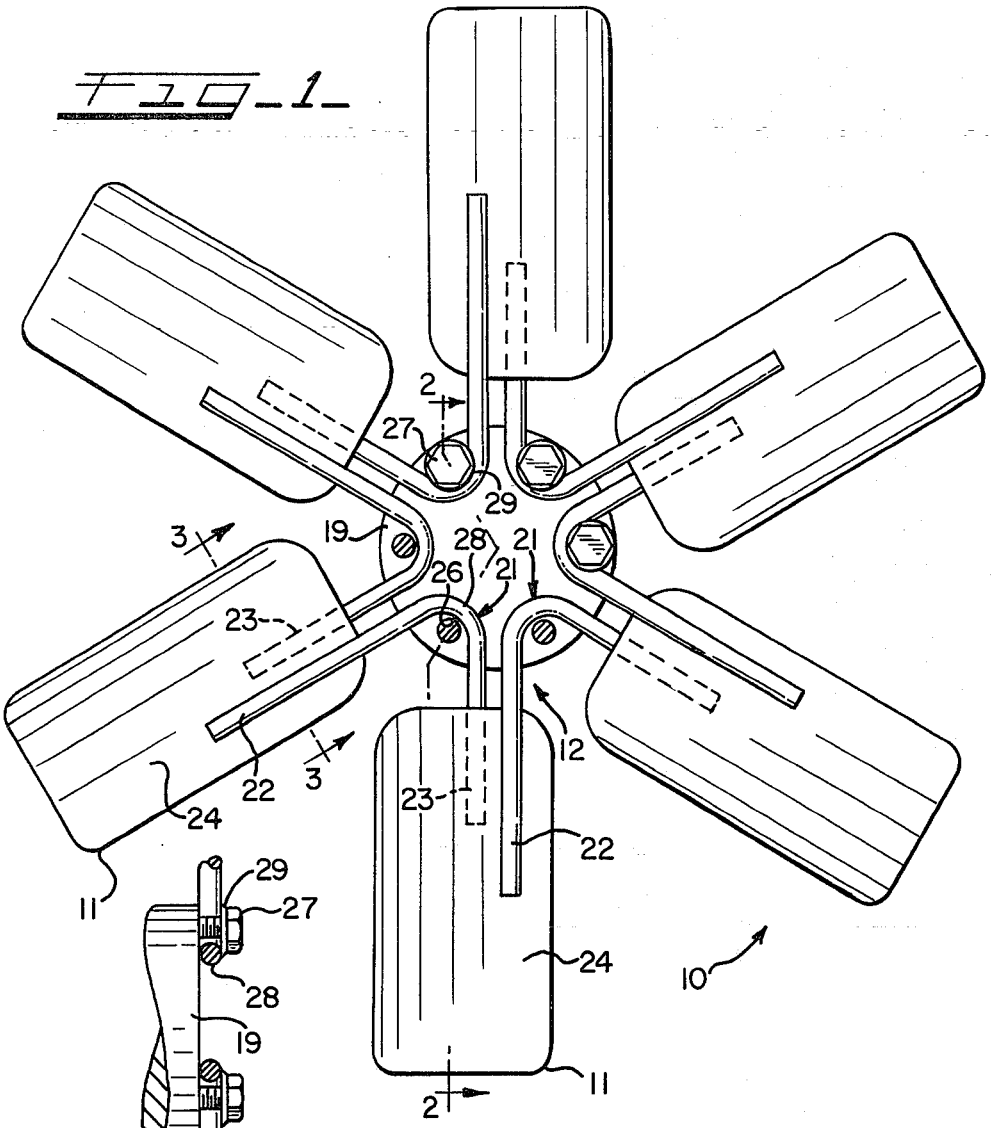
FIG. 1 is a front view of one embodiment of a fan blade spider formed or shaped from rod, wire or bar stock.
Figure 2:
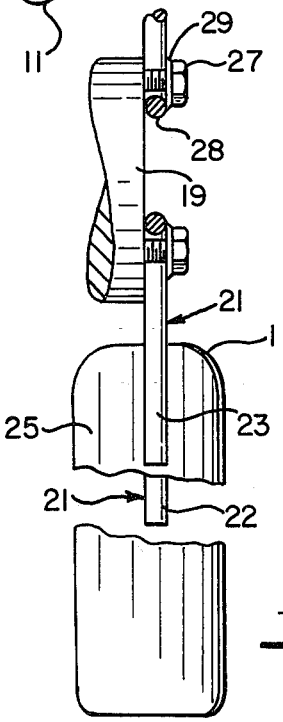
FIG. 2 is a partial cross-sectional side view taken on lines 2—2 of FIG. 1.
Figure 3:
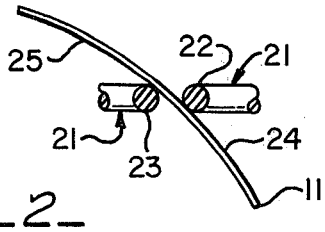
FIG. 3 is a partial cross-sectional end view taken on lines 3—3 of FIG. 1.
Figure 4:
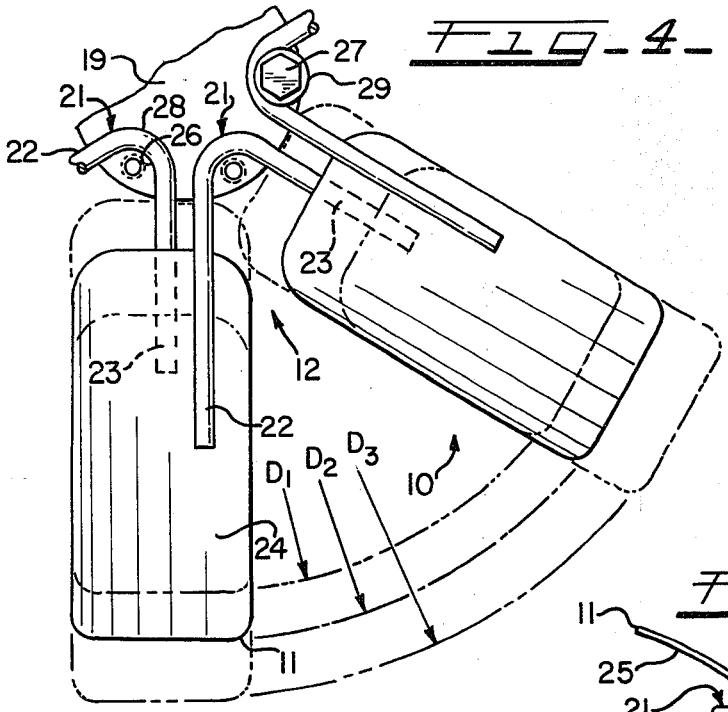
FIG. 4 is similar to FIG. 1 showing various outside diameters of the fan blade assembly.
Figure 5:
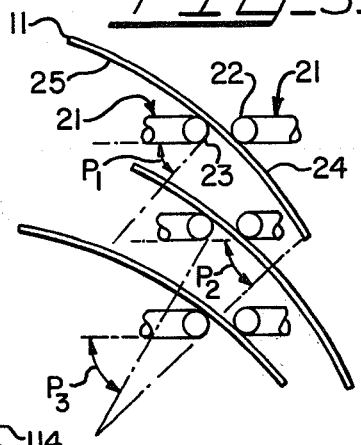
FIG. 5 is similar to FIG. 3 showing various angular positions of the fan blade.

According to one embodiment of my invention which is shown in FIGS. 1–5, inclusive, the prior art radial arms and ringed hub portion are replaced by a plurality of arm means or bent rod members 21 arranged side-by-side in a circular pattern or circumferentially spaced about a central rotational axis forming a spider means 12. Each circumferentially spaced bent member 21 has a radially extending first arm 22 connected to the convex side 24 of one each fan blade 11 of the plurality and a radially extending second arm 23 connected to the concave side 25 of one each adjacent fan blade 11, of the plurality, so that the first and second arms 21 and 23, of any two adjacent bent members 21 are in spaced-apart parallel relationship to one another on opposite sides of one common fan blade 11 of the plurality. Although the first and second arms 22 and 23 are shown to be of different lengths, they can be of equal lengths without departing from the teachings and spirit of my invention. The completed fan blade assembly 10 may now be mounted for rotation to the rotor or motor shaft 19 by the mounting bolts 27 nested in the space between the concave 26 at the bend forming the bridge 28 and the first and second arms 22 and 23 of the V-shaped bent members 21. The bolts 27 are provided with enlarged gripping surfaces 29, which may also be washers, which engage with the bridges 28 of the V-shaped bent members 21 and clamp the fan blade assembly 10 firmly to the rotor 19. FIGS. 4 and 5 show various diameters and blade angle variations or pitches which are readily available with the fan spider means 12 and with the alternate embodiments of the fan spider means as will be explained further on. Once the angular position or pitch and the outside diameter of the fan blades 11 are established, the fan blades 11 are then fixed to the first and second arms 32 and 33 by welding or soldering if the blades 11 and spider means 12 are metallic, or by bonding or gluing if either or both the fan blades 11 and the spider means 12 are made from some other material other than metal.

Figure 7:
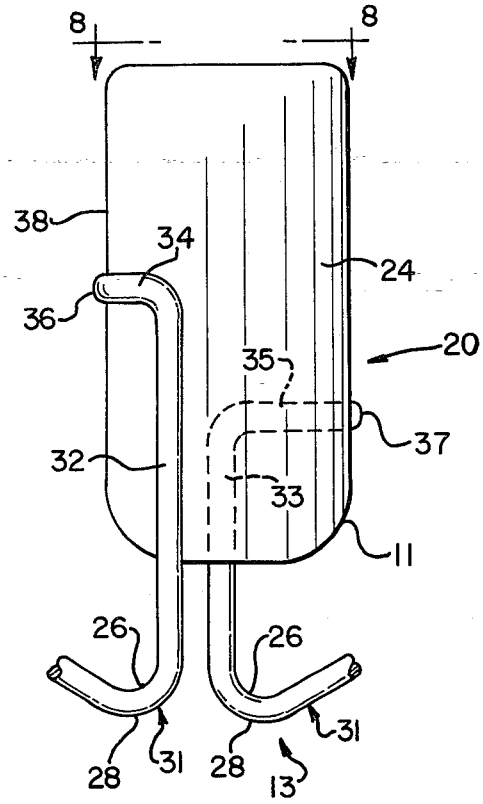
FIG. 7 is a partial front view of a second embodiment of a fan blade spider formed or shaped from rod, wire or bar stock.
Figure 8:
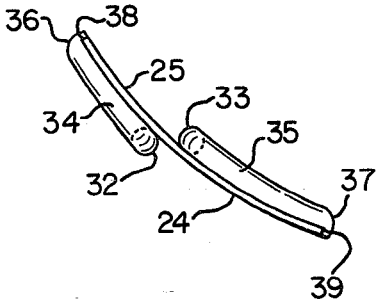
FIG. 8 is a partial cross-sectional end view taken on lines 8—8 of FIG. 7.

In FIGS. 7 and 8, the terminal end portions 34 and 35 of first and second arms 32 and 33 are bent over approximately 90° and are curved respectively to fit the convex and concave sides 24 and 25 of each fan blade 11. The tips or terminal ends 36 and 37 of the bent terminal end portions 34 and 35 are hooked around the edges 38 and 39 of each fan blade 11 in a gripping manner. The angular position of the fan blades 11 is set by varying the length of the curved terminal end portions 34 and 35, and the outside diameter of the fan assembly 20 is set by sliding the fan blades 11 radially inwardly or outwardly between the gripping hooked ends or tips 36 and 37. The fan blades 11 are then secured to the first and second arms 32 and 33 of bent members 31 and to the curved terminal end portions 34 and 35 by any of the aforementioned ways depending upon the materials used for the blades 11 and the fan spider means 13.

Figure 9:
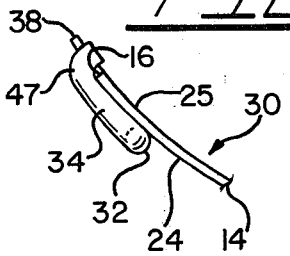
FIG. 9 is a partial cross-sectional end view of a third embodiment of the fan blade spider and a second embodiment of the fan blade.

In FIG. 9, the tips or hooked ends 47 (only one shown) of the curved terminal end portions 34 and 35 are bent 90° and pass through holes 16 (only one shown) provided at the lateral or convex and concave sides 24 and 25 of each fan blade 14. The angular position of the fan blades 14 is determined, as before, by the lengths of the curved terminal end portions 34 and 35 and by the placement of the two holes 16 in each fan blade 14, which also determines the outside diameter of the fan blade assembly 30.

Figure 10:
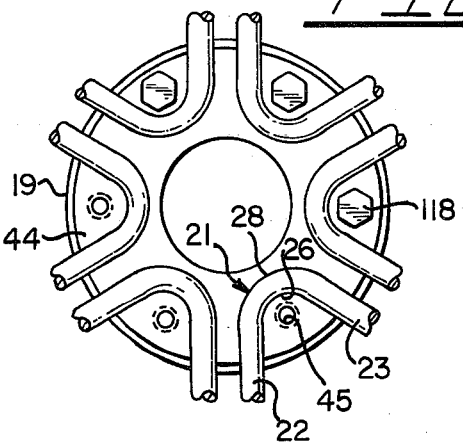
FIG. 10 is a partial front view of the fourth embodiment of the fan blade spider.

In FIG. 10, the bend or bridge 28 of each bent member 21 is connected or fixed to a hub or ring member 44. The ring member 44 is provided with a plurality of holes or openings 45 which are situated within the space between the concave 26 of the bend or bridge 28 between the first and second arms 22 and 23. Mounting bolts 118 are inserted through the holes 45 and secure the hub 44 to the rotor 19.

Figure 12:
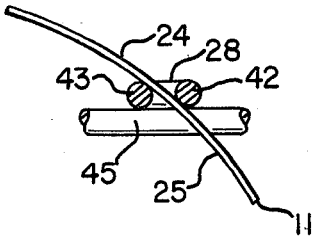
FIG. 12 is a partial end view taken on lines 12—12 of FIG. 11.
Figure 11:
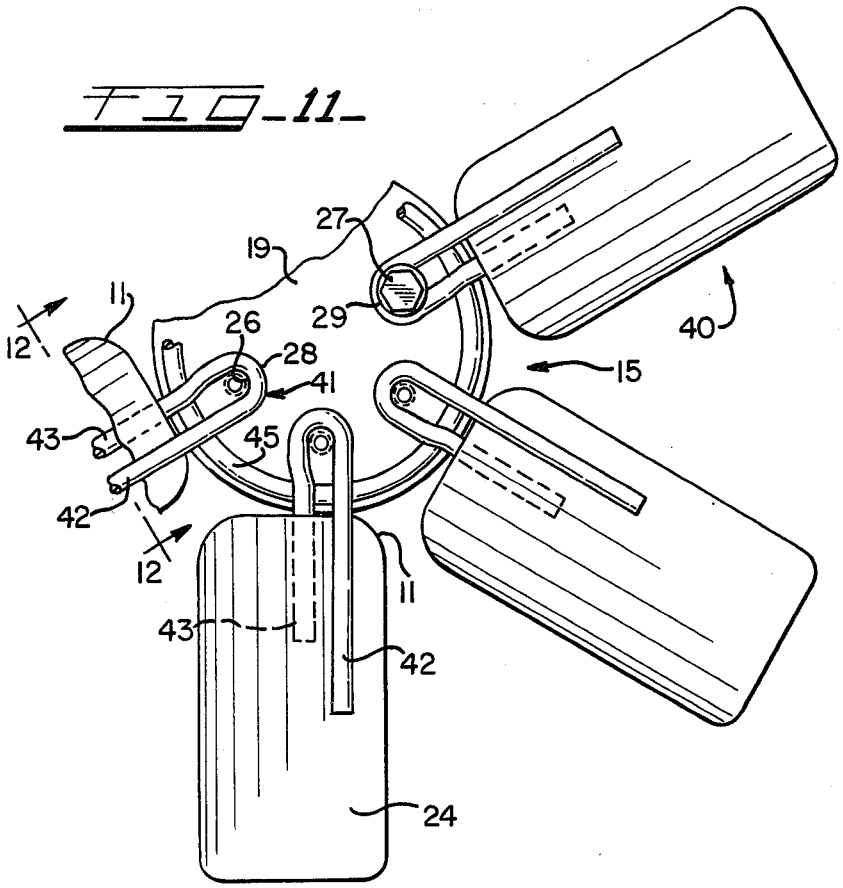
FIG. 11 is a partial front view of a fifth embodiment of the fan blade spider.

In FIGS. 11 and 12 the bridge 28 of the bent members 41 is bent at an acute angle forming a generally U-shaped member 41 and the first and second radially extending arms 42 and 43 lie on opposite sides of the same fan blade 11 of the plurality. The bent members 41 of the fan spider means 15 and the fan blades 11 are circumferentially spaced or arranged in a circular pattern around a ring or hub member 45 concentric with the rotational axis. The second arm 43 extends radially along the concave side 25 of the fan blade 11, and parallel to the first arm 42 on the convex side 24 of the same blade 11 of the plurality. The bend at the inboard area of the second arm 43 is provided to bring the second arm 43 into closer proximity to the first arm 42 after an enlarged space has been provided for bolts 27. Once the angular position and the outside diameter of the fan blades 11 are determined, the fan blades 11 are then fixed to the respective first and second arms 42 and 43 and the bent members 41 are fixed to the ring member or hub 45. The fan blade assembly 40 is mounted to the rotor 19 by passing the mounting bolts 27 within the space radially inwardly of the ring member or hub 45 and between the first and second arms 42 and 43 and the concave 26 of the bridge 28. The gripping surfaces 29 of the mounting bolts 27 engage the bridges 28 and secure the fan blade assembly 40 to the rotor 19.

In FIGS. 13 and 14, the first and second radially extending arms 52 and 53 of each of the bent members 51 lies on opposite sides of a respective one blade 11 of the plurality and the terminal ends 54 and 55 thereof are respectively connected to a second arm 53 of an adjacent arm means 51, on one edge side 38 of the respective one blade 11, and to a first arm 52 of another adjacent arms means 51 on the other edge side 39 of the respective one blade 11, by means of a generally Z-shaped member 56, as shown in FIG. 14, forming a generally rosette shaped spider means 17. The generally parallel bars 57 and 58 of the Z-shaped member 56 are curved to correspond respectively to the convex and concave sides 24 and 25 of the fan blades 11. The second arm 53 is bent at 46 in order to extend radially along the concave side 25 of the fan blade 11 parallel to the first arm 52 on the opposite convex side 24. Once the angular positions of the blades 11 and the outside diameter of the fan blade assembly 50 is determined, the blades are then fixed to the Z-shaped members 56 and to the first and second arms 52 and 53 as described previously. The fan blade assembly 50 is mounted to the rotor 19 by passing mounting bolts 27 through the space between the arms 52 and 53 and the concave 26 of the acute bend or bridge 59.

In FIGS. 15 and 16, the first arm 62 is connected to the convex side 24 of one blade 11, and the second arm 63 is connected to the concave side 25 of an adjacent fan blade 11. The terminal ends 64 and 65 of the first and second arms 62 and 63 of each bent member 61 of the plurality are connected to each other by a Z-shaped member 66 forming a plurality of generally triangular fan spider segment means 18. The generally parallel bars 67 and 68 of the Z-shaped member 66 are curved to correspond respectively to the convex and concave side 24 and 25 of the fan blades 11. The bent members 61 are arranged side-by-side in a circular pattern, or circumferentially spaced, and the blades 11 are angularly positioned between the parallel radially extending first and second arms 62 and 63 respectively of two adjacent arm means 61, and the outside diameter of the fan blade assembly 60 is determined and then the plurality of fan blades 11 are fixed to the first and second arms 62 and 63 and to the generally parallel bars 67 and 68 of the Z-shaped member 66. The fan blade assembly 60 is mounted to the rotor 19 by passing mounting bolts 27 through the space between the arms 62 and 63 and the concave 26 of the obtuse bend or bridge 28.

What is claimed is:

1. A fan blade assembly, comprising:

a plurality of fan blades circumferentially spaced about a central rotational axis; and a plurality of rod members equal in number to the plurality of fan blades, each rod member bent intermediate the ends thereof forming first and second arms bridged by an arch, the bent rods circumferentially spaced about the central rotational axis with the arches converging toward the central rotational axis and the first arms extending radially outwardly and respectively embracing one side of the circumferentially spaced fan blades and the second arms extending radially outwardly substantially parallel to the first arms and respectively embracing a second side opposite the one side of the circumferentially spaced fan blades.

2. A fan blade assembly, according to claim 1, wherein:

the fan blades are angularly and radially adjustable between their respective embracing first and second arms and are fixed thereto at a selected pitch and outside diameter.

3. A fan blade assembly, according to claim 2, wherein:

the one side of each fan blade is shaped convex and the second side is shaped concave.

4. A fan blade assembly, according to claims 2 or 3, wherein:

each bent member is bent at the arch into a generally V-shape and wherein each first arm of one V-shape member of the plurality lies on the same fan blade of the plurality with each second arm of one adjacent V-shape member of the plurality.

5. A fan blade assembly, according to claims 2 or 3, wherein:

each bent member is bent at an acute angle at the arch into a generally U-shape and wherein the first and second arms of each U-shape member of the plurality lie on opposite sides of the one each same fan blade of the plurality.

6. A fan blade assembly, according to claims 4, wherein:

the arches are fixed to a ring member concentrically spaced about the central rotational axis.

7. A fan blade assembly, according to claim 6, wherein:

rotor mounting means are provided between the first and second arms and the arch of each bent member for mounting the assembly to a rotor.

8. A fan blade assembly according to claim 4, wherein:

a plurality of generally Z-shaped members corresponding in number to the plurality of V-shape members join the first and second arms of each V-shape member, and wherein one lateral bar of each Z-shaped member is associated with the first arm of each V-shape member and is shaped to conform to and embrace the one side of each fan blade and a second lateral bar of each Z-shaped member is associated with the second arm of each V-shape member and is shaped to conform to and embrace the second side of each fan blade.

9. A fan blade assembly according to claim 5, wherein:

a plurality of generally Z-shaped members corresponding in number to the plurality of U-shape members joined each first arm of one each U-shape member of the plurality to each second arm of one adjacent each U-shape member of the plurality, and wherein one lateral bar of each Z-shaped member is associated with the first arm of the one each U-shape member of the plurality and is shaped to conform to and embrace the one side of the one each fan blade of the plurality and a second lateral bar of each Z-shaped member is associated with the second arm of the one each adjacent U-shape member of the plurality.

10. A fan blade assembly according to claim 4, wherein:

the first arm of each V-shape member is bent at a terminal end portion thereof and is shaped to conform to and embrace the one side of the one fan blade of the plurality and the second arm of each V-shape member is bent at a terminal end portion thereof and is shaped to conform to and embrace the second side of the one same fan blade of the plurality.

11. A fan blade assembly according to claim 10, wherein:

the bent terminal end portion of the first and second arms end in hooks gripping the edges of the fan blades.

12. A fan blade assembly according to claim 10, wherein:

the bent terminal end portions of the first and second arms end in hooks passing through holes provided in the first and second sides of the one same fan blade of the plurality.

* * * * *